US009566611B2

(12) United States Patent
Lang-Koetz et al.

(10) Patent No.: US 9,566,611 B2
(45) Date of Patent: Feb. 14, 2017

(54) METHOD FOR TREATING THE SURFACE OF OBJECTS

(71) Applicant: EISENMANN SE, Böblingen (DE)

(72) Inventors: Claus Lang-Koetz, Stuttgart (DE); Ralph Meier, Waldenburch (DE); Herbert Schulze, Aidlingen (DE)

(73) Assignee: Eisenmann SE, Boeblingen (DE)

( * ) Notice: Subject to any disclaimer, the term of this patent is extended or adjusted under 35 U.S.C. 154(b) by 0 days.

(21) Appl. No.: 14/405,869

(22) PCT Filed: May 29, 2013

(86) PCT No.: PCT/EP2013/001577

§ 371 (c)(1),
(2) Date: Dec. 5, 2014

(87) PCT Pub. No.: WO2013/182280

PCT Pub. Date: Dec. 12, 2013

(65) Prior Publication Data

US 2015/0174612 A1 Jun. 25, 2015

(30) Foreign Application Priority Data

Jun. 6, 2012 (DE) ..... 10 2012 011 254

(51) Int. Cl.

| | |
|---|---|
| ***B41M 5/124*** | (2006.01) |
| ***B05D 7/14*** | (2006.01) |
| ***B05D 5/06*** | (2006.01) |
| ***B05D 7/00*** | (2006.01) |

(52) U.S. Cl.

CPC . *B05D 7/14* (2013.01); *B05D 5/06* (2013.01); *B05D 7/50* (2013.01); *B05D 7/57* (2013.01)

(58) Field of Classification Search

CPC ..... B41M 5/124; B41M 5/1246; B05D 7/144; B05D 7/14

USPC ..... 427/258, 256, 261, 280, 286, 355

See application file for complete search history.

(56) References Cited

U.S. PATENT DOCUMENTS

| | | | | |
|---|---|---|---|---|
| 2,403,084 A | | 1/1942 | James | |
| 4,230,760 A | * | 10/1980 | Schneider | B65D 75/46 427/286 |
| 4,247,587 A | * | 1/1981 | Cherault | B05D 7/14 204/488 |
| 4,299,637 A | * | 11/1981 | Oberdeck | A63F 3/065 101/483 |
| 4,431,321 A | * | 2/1984 | Trimble | B44B 5/0095 400/130 |

(Continued)

FOREIGN PATENT DOCUMENTS

| | | |
|---|---|---|
| CN | 1561265 A | 5/2005 |
| DE | 29 45 217 A1 | 3/1982 |

(Continued)

OTHER PUBLICATIONS

DE3445401 Translation Jun. 26, 1986.*

Office Action from the Chinese Patent Office dated Jul. 6, 2016 for related CN Pat. App. No. 201380029763.2, 6 pages.

*Primary Examiner* — Cachet Sellman

(74) *Attorney, Agent, or Firm* — Factor Intellectual Property Law Group, Ltd.

(57) ABSTRACT

In a method for treating the surface of objects, in particular vehicle bodies, the object is provided with a functional pattern by means of a coating process.

22 Claims, 4 Drawing Sheets

(56) References Cited

U.S. PATENT DOCUMENTS

| | | | | |
|---|---|---|---|---|
| 4,513,027 | A * | 4/1985 | Skukowski | C09D 11/50 101/491 |
| 5,436,027 | A * | 7/1995 | Offer | B05D 1/325 427/10 |
| 5,744,223 | A * | 4/1998 | Abersfelder | B60R 25/00 428/195.1 |
| 5,925,402 | A * | 7/1999 | Nacker | B05D 3/06 427/195 |
| 6,259,056 | B1 * | 7/2001 | Cowden | G05B 19/4183 219/121.69 |
| 6,376,016 | B1 * | 4/2002 | Farquhar | B05D 5/06 427/258 |
| 2003/0108725 | A1 | 6/2003 | Hamilton et al. | |
| 2006/0068094 | A1 * | 3/2006 | Cole | B05B 13/0221 427/240 |
| 2007/0166463 | A1 * | 7/2007 | Kelly | B01D 46/30 427/345 |
| 2010/0279043 | A1 | 11/2010 | Hsu et al. | |
| 2011/0014371 | A1 * | 1/2011 | Herre | B05B 12/1418 427/236 |
| 2011/0104394 | A1 | 5/2011 | Beier et al. | |
| 2011/0297749 | A1 | 12/2011 | Lezhnev et al. | |
| 2012/0321799 | A1 * | 12/2012 | Hu | B29C 39/148 427/278 |

FOREIGN PATENT DOCUMENTS

| | | | | |
|---|---|---|---|---|
| DE | 3445401 | A1 * | 6/1986 | G08G 1/017 |
| DE | 201 00 608 | U1 | 4/2001 | |
| DE | 10 2009 004 878 | A1 | 7/2010 | |
| DE | 10 2010 047 808 | A1 | 5/2011 | |
| DE | 10 2010 006 665 | A1 | 8/2011 | |
| EP | 2 208 542 | A1 | 7/2010 | |

* cited by examiner

METHOD FOR TREATING THE SURFACE OF OBJECTS

RELATED APPLICATIONS

This application is a national phase of International Patent Application No. PCT/EP2013/001577, filed May 29, 2013, which claims the filing benefit of German Patent Application No. 10 2012 011 254.8, filed Jun. 6, 2012, the contents of both of which are incorporated herein by reference.

FIELD OF THE INVENTION

The invention relates to a method for surface-treating objects, in particular vehicle bodies.

BACKGROUND OF THE INVENTION

Many objects are subjected to a surface treatment in the course of their production. During this, the quality of the surface is for example refined and/or protected against external influences. For example, vehicle bodies or parts thereof, but also a plurality of other objects such as sports equipment or the like, are provided with a paint finish for this purpose.

It is frequently desirable for objects to be customised, thereby differentiating objects from other objects of a similar production line. On the one hand, this applies to objects during the production process on the manufacturing side, for example to link product information to the object. On the other hand, the end consumers and end users of an object often desire that, after its manufacture, the object differs individually from other, otherwise identical, objects so that their object can also be given its own personal note. To this end, objects are subsequently provided with stickers or the like. However, it may also be desirable for objects to be customised through technical features which differentiate one object from another object or a first product line from a second product line.

SUMMARY OF THE INVENTION

It is an object of the invention to provide a method of the type mentioned at the outset, which takes these ideas into account.

This object may be achieved in that
the object is provided with a functional pattern by means of a coating procedure.

According to the invention, it has been recognised that these features can result in particularly reliable and durable customisation. Instead of easily detachable stickers or retrospective additions such as labels or technical components or the like, the object is provided with a coating which brings about the desired customisation. The type and nature of such a functional pattern is discussed again in detail below.

It is particularly favourable if the object is provided with the functional pattern in the course of a painting process in which the object is provided with a coating in one or more steps in a coating chamber. Closely related operating steps are thereby linked together, namely coating the object with a coating, such as for example a paint, on the one hand and coating the object with the functional pattern on the other.

During this, the functional pattern can be integrated in the coating of the object or applied externally to the coating of the object. If the functional pattern is integrated in the coating of the object, it is possible to achieve effective protection of the functional pattern against external influences and against external manipulations.

It is particularly practicable if the functional pattern is imprinted on a printing surface of the object, which is a surface region of the object which, during the coating process for the coating or after its completion, is located externally and is available for printing. A printing surface can therefore also be created by an intermediate layer of paint during a painting process and then subsequently covered with a further layer.

It can therefore be advantageous if the printing surface is formed on the surface of a material wall of the object or a layer of a coating material.

It is particularly favourable if the functional pattern is a custom pattern, an information pattern or a technical pattern. This is also discussed again in detail below.

If the functional pattern is formed as a relief pattern, it is additionally or complementarily possible to detect it by touch, which can be advantageous in many cases. In addition to other possible functions, a relief pattern is distinguished by raised portions and depressions.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawings, which show.

DETAILED DESCRIPTION OF THE PRESENT INVENTION

Figure 1:
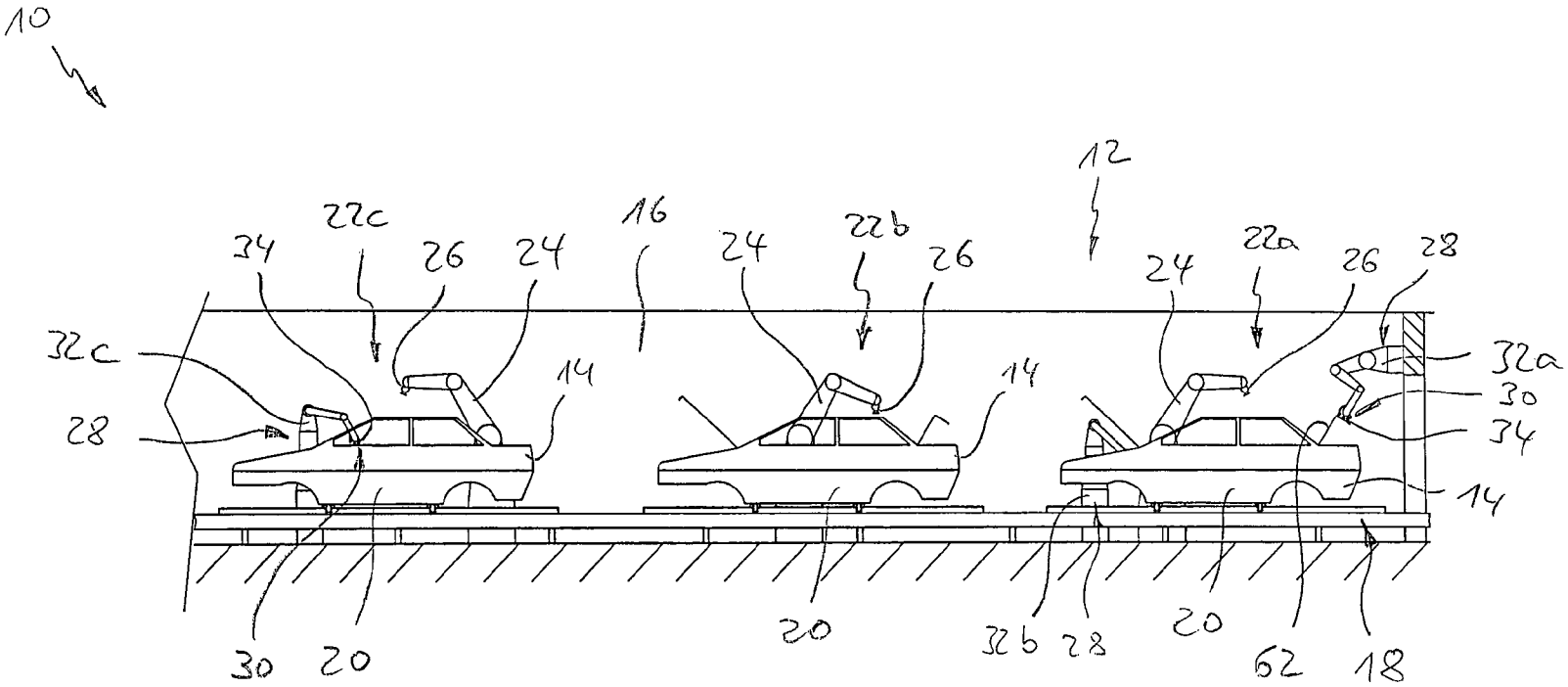
FIG. 1 a schematic view of a paint booth in which application robots and a conveyor system are arranged, which are used to paint vehicle bodies and provide them with a functional pattern.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In FIG. 1, as an example for surface treatment of an object, 10 denotes an installation as a whole for coating objects, which is shown by way of example as a painting installation 12 in which objects are painted and of which only one portion is shown. Vehicle bodies 14 are shown in FIG. 1 as an example of objects to be coated. Instead of vehicle bodies, it is also possible for other objects to be coated or painted, the aim being to refine or protect their surface.

The painting installation 10 comprises a paint tunnel 16 as a coating chamber, in which there is arranged a conveyor system 18 which is known per se and by means of which the vehicle bodies 14 are conveyed through the paint tunnel.

On their path through the paint tunnel 16, the vehicle bodies 14 are provided with a coating in the form of multi-layer paintwork 20, to which end the vehicle bodies 14 pass through a plurality of coating zones 22 of which three coating zones 22*a*, 22*b* and 22*c* are shown from right to left in FIG. 1. Arranged in each coating zone 22 is a coating robot in the form of a multi-axis robot 24, as is known per se and by means of which the paint 20 is applied to the vehicle body 14. To this end, each painting robot 24 carries along a paint-application device, such as for example a high-rotation atomiser 26.

In the paint tunnel 16, the vehicle bodies therefore pass through a coating process in the form of a painting process.

Also located in the coating zones 22*a* and 22*c* in addition to the painting robots 24 are pattern application robots 28 with a pattern application device 30 which, in the present exemplary embodiment, are constructed as multi-axis print robots 32 and as a print head 34, with the latter operating according to the principle of an inkjet print head. In the present exemplary embodiment, two print robots 32*a* and 32*b* are arranged in the coating zone 22*a*, whereas only a single print robot 32*c* is present in the coating zone 22*c*.

In general terms, the pattern application device 30 is movably guided. The pattern application device 30 does not have to be carried by a separate pattern application robot 28, but can also be guided by a paint robot 24. To this end, this can comprise for example a paint application device and a pattern application device 30 as a type of exchangeable head.

It is also alternatively possible to use other technologies as robots. For example, pattern application devices 30 can be mounted on a portal and thereby moved relative to the object to be coated. It is also alternatively possible for the pattern application device 30 to be substantially or completely stationary and for the object to be moved with respect to the pattern application device 30.

The vehicle bodies 14 are provided with a functional pattern 36 by means of a coating procedure with the aid of the pattern application robots 28. This functional pattern 36 can be integrated in the paintwork 20 or applied externally thereto. In the latter case, the pattern application robots 28 and the print robots 32 can also be arranged in a treatment chamber which is separate from the paint tunnel 16 and through which the vehicle bodies 14 pass following the painting procedure.

Details relating to the functional pattern 36 are discussed again in detail below.

In the present case of the print robots 32, the functional pattern 36 is imprinted on a printing surface 38 of the vehicle body 14. A printing surface 38 here is a surface region of the vehicle body 14 which, during the painting process or after its completion, is located externally and is available for printing.

This is shown in FIGS. 2 to 5. In these, 40 denotes a material wall of an object, i.e. in the present example a metal wall of a vehicle body 14.

The metal wall 40 now bears the paintwork 20 which is shown in FIGS. 2B, 3B, 4B and 5C and here comprises for example three layers in each case. In the painting process, a layer of a primer 42 is firstly applied to the metal wall 40. The primer 42 is then provided with a colour-imparting top coat 44. A finishing coat 46 is then applied to the top coat 44. This can be a transparent clear coat or a coloured coat. A painting process of this type is known per se.

Figure 2:
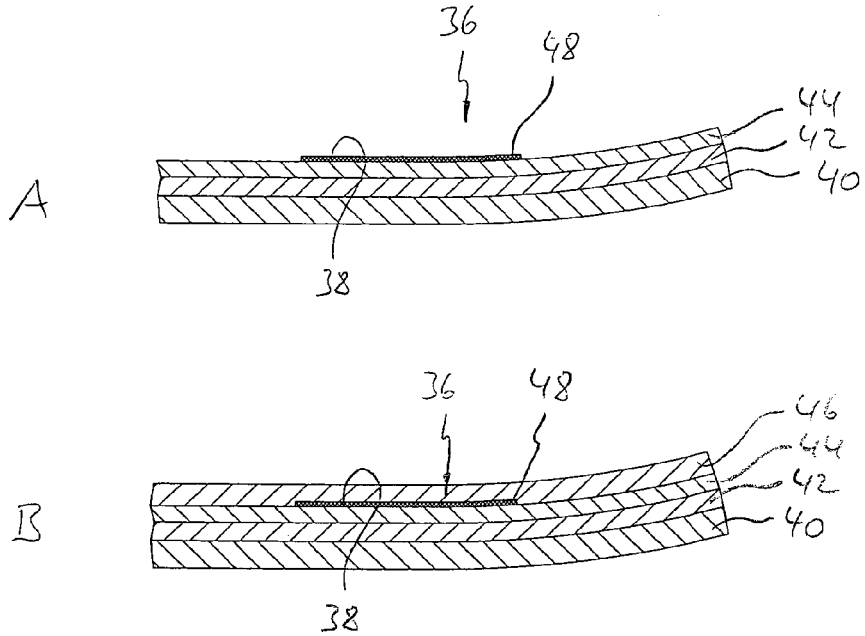
FIGS. 2 to 5 different variants of the generation of a functional pattern.

FIG. 2 shows that the functional pattern 36 has been applied to the top coat 44 of the paintwork 20 as a single-layer functional pattern 48 in a first process step A before the paintwork is provided with the finishing coat 46. In this case, the top coat 44 therefore forms the printing surface 38. In a second process step B, the top coat 44 and the single-layer functional pattern 48 are then coated with the finishing coat 46 and thereby sealed externally.

Figure 3:
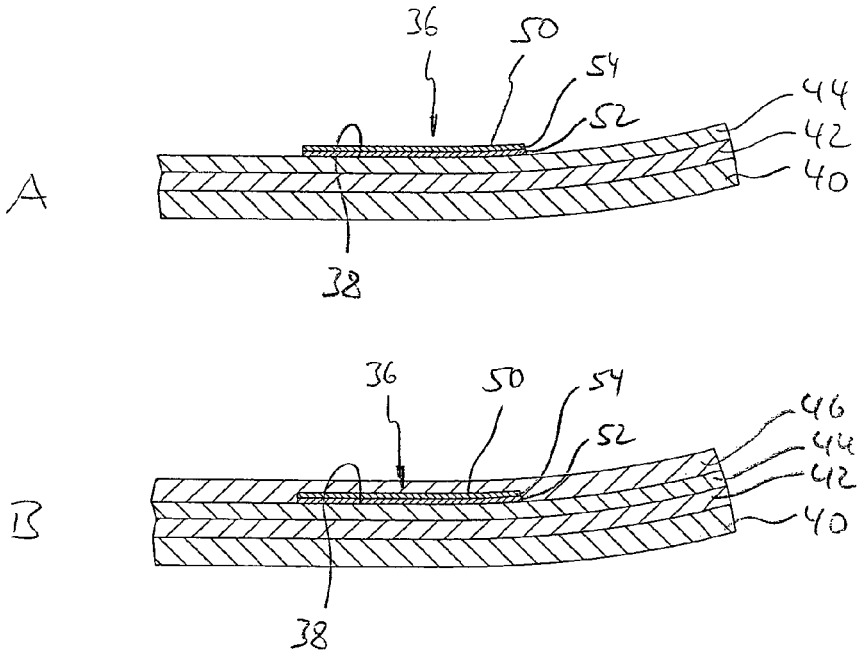

FIG. 3 shows a two-layer functional pattern 50 having a first layer 52 and a second layer 54. The top coat 44 also forms the printing surface 38 here. In a first process step A, the first layer 52 is applied to the top coat 44 by the pattern application robot 28 in a first partial step. In a second partial step of the process step A, the first layer 52 of the two-layer functional pattern 50 is then covered by the second layer 54. In a second process step B, the top coat 44 and the two-layer functional pattern 50 are then coated with the finishing coat 46.

Figure 4:
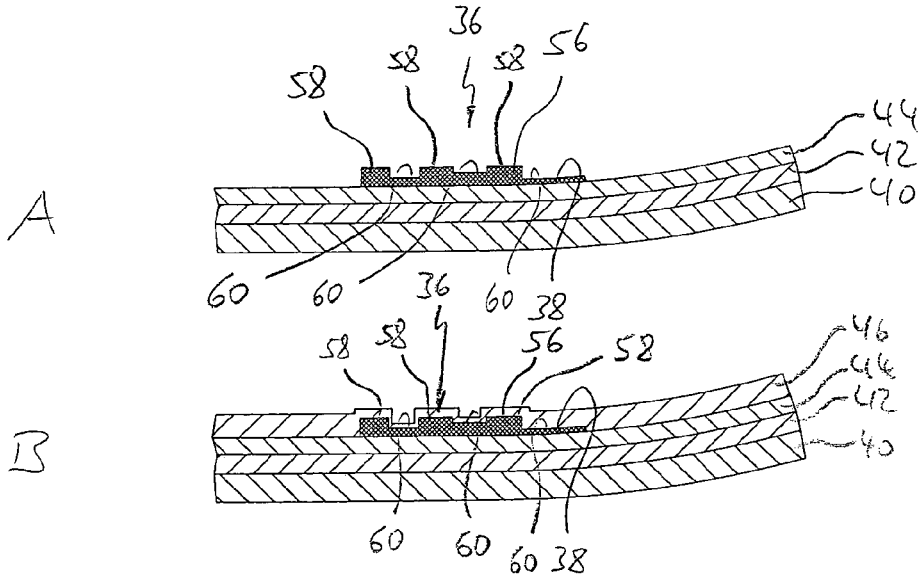

In FIG. 4, a relief pattern 56 is shown as the functional pattern 28, and this is likewise applied to the top coat 44 in a first process step A, which therefore in turn serves as the printing surface 38. The relief pattern 56 comprises raised portions 58 and depressions 60 which an observer is able to detect visually or by touch. So that it is still possible to feel the relief pattern 56 after completion of the paintwork, the finishing coat 46 is applied to the top coat 44 and the relief pattern 56 in a second process step B in such a way that the finishing coat 46 follows the surface characteristics of the relief pattern 56 so that the relief contour of the relief pattern 56 is ultimately reflected in the surface characteristics of the finishing coat 46.

If required, the finishing coat 46 can also be applied to the relief pattern 56 as a layer which evens out the raised portions 58 and depressions 60 so that a smooth paint surface of the vehicle body 14 is formed without structuring in the region of the relief pattern. In this case, the relief pattern 56 can only be detected visually.

Figure 5:
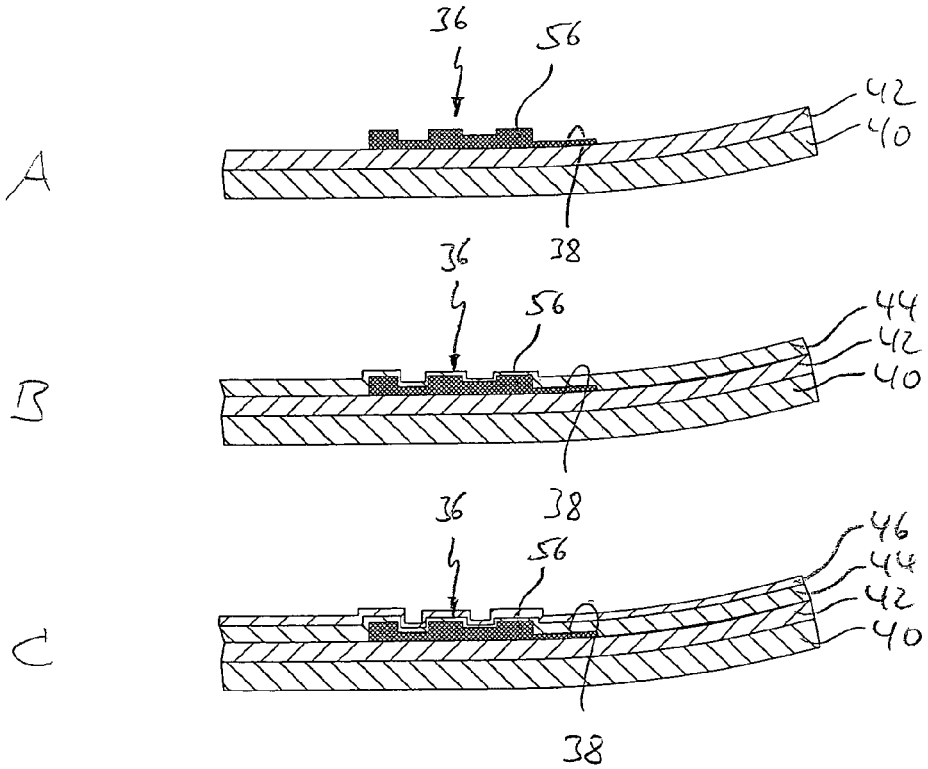

FIG. 5 shows a modification in which the relief pattern 56 has not been applied to the top coat 44 but has instead already been applied to the primer 42 in a first process step A, which therefore creates the printing surface 38. In a second process step B, the primer 42 and the relief pattern 56 are then covered with the top coat 44 which is then sealed with the finishing coat 46 in a third process step C. The surface contour of the relief pattern 56 is thereby maintained on the surface of the finishing coat 46. For the sake of clarity, the raised portions 58 and depressions 60 of the relief pattern 56 are not provided with reference numerals in FIG. 5.

The finishing coat 46 or even the top coat 44 can alternatively be applied to the relief pattern 65 such that its surface structure is evened out and the finishing coat 46 again forms a smooth surface without structuring in the region of the relief pattern 56.

In a modification with is not shown specifically here, the functional pattern 36 is printed directly onto the metal wall 40 and then covered by the three layers of primer 42, top coat 44 and finishing coat 46.

Possible functional patterns 36 are patterns which can be applied to the printing surface 38 used by means of printing methods which are known per se, in particular according to the principle of inkjet printers.

Of interest here are, for example, custom patterns by means of which a vehicle can already be customised for the end consumer and end user during the printing process. Custom patterns of this type can be for example photos, pictures, text, patterns and structures or the like, the individual specifications of which can be given to the manufacturer by the end consumer or end user.

Custom patterns of this type can be applied for example as décor patterns to the interior of the vehicle body 14. In FIG. 1, this is shown for example by the print robot 32*c* in the coating zone 22*c*, which guides the print head 34 in the interior of the vehicle body 14. One consideration, for example, may be to imprint a photo or picture of a family member of the end consumer in the interior of the vehicle body as a décor pattern.

However, it is also possible to provide the exterior of a vehicle body 14 accordingly with custom patterns, as shown by the print robot 32*a* in the treatment zone 22*a*. Here, the print robot 32*a* is printing on an open tailgate 62 of the vehicle body 14. For example, the tailgate 62 of the vehicle body 14 can thus be provided with a custom pattern which replaces the customary manufacturer emblem.

Figure 6:
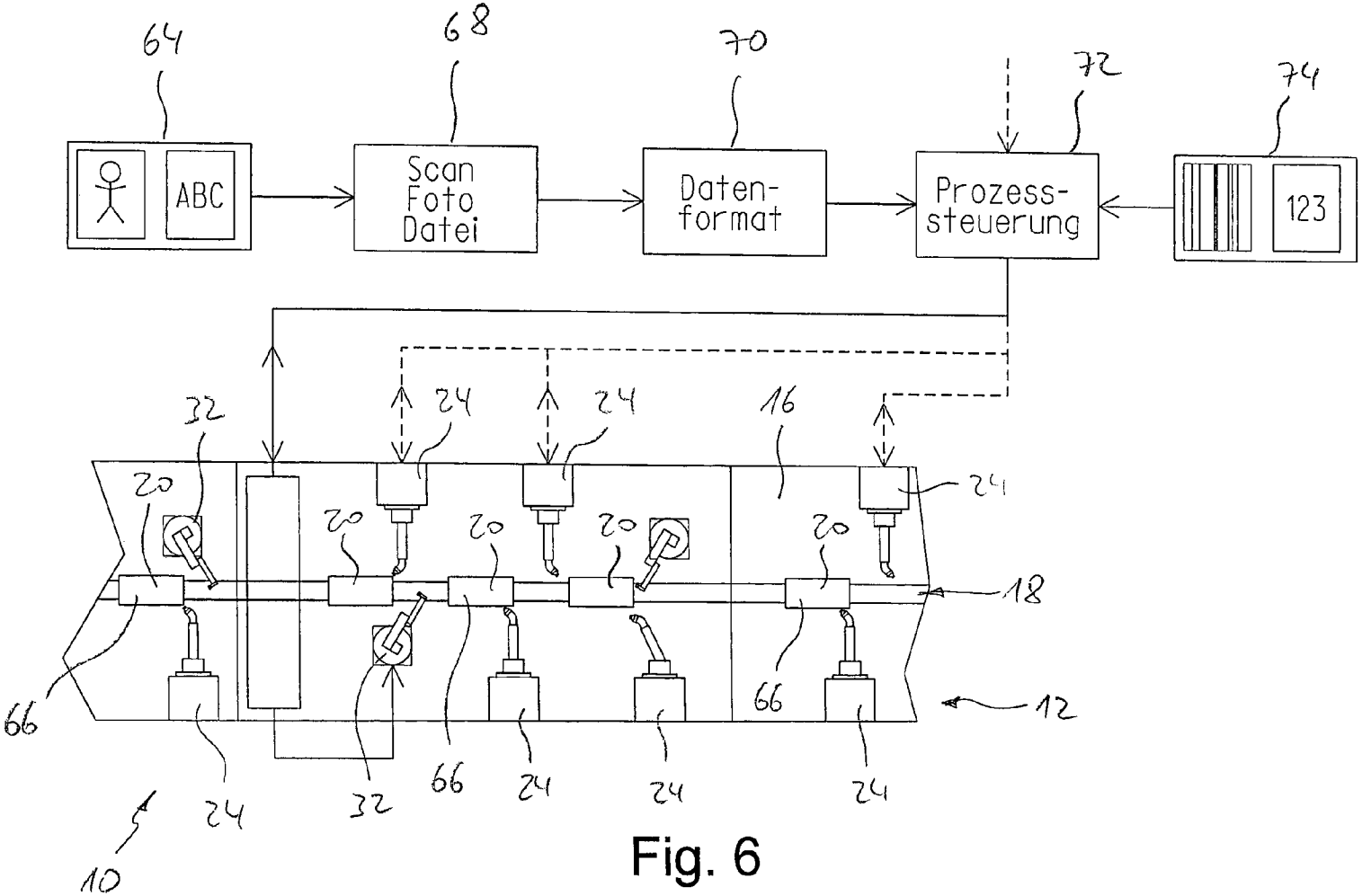
FIG. 6 a schematic view of a process sequence for generating a functional pattern.

Custom patterns of this type can be transferred to the manufacturer for example as an image 64, as shown in FIG. 6. In this, deviating from FIG. 1, a plurality of painting robots 24 are arranged in the paint tunnel 16 and the print robots 32 are positioned differently. Moreover, instead of vehicle bodies 14, objects 66 are shown in general, of which only some have a reference numeral.

The image 64 is firstly electronically converted into a data file 68. If required—or if a data file 68 is transferred directly to the manufacturer by the client—further conversion 70 may be necessary into a data format which can be processed by a process control 72 for the print robot(s) 32 of the painting installation 12. In the present exemplary embodiment, the process control 72 also communicates with the painting robots 24 as shown in FIG. 6 by the dashed lines.

The process control 72 then coordinates the painting process and controls the painting robots 24 and the print robots 32 such that a customised vehicle body 14 or a customised object 66 is produced, which corresponds to the wishes of the client.

A functional pattern 36 can also be formed as information patterns which provide information about or relating to the object to be coated, i.e. information about or relating to the vehicle in this case. This includes for example serial or production numbers, visually coded product information such as barcodes, QR codes or holograms in which equipment features and ranges are stored, particularly maintenance or servicing directions, classifications, pictograms, brand names and company logos or the like. In the manner described above, such information patterns can be incorporated in particular in the paintwork 20 and therefore be protected against external influences.

This can be particularly advantageous in the case of serial numbers. For example, if the chassis number applied to the vehicle body is removed or altered, this is readily noticed as it means disturbing the paintwork 20 rather than simply changing a label. FIG. 1 shows such a chassis number being printed on a vehicle body 14 by the print robot 32*b* in the treatment zone 22*a*, whereof the print head 34 (not shown) is guided in the engine compartment of the vehicle body 14.

In FIG. 6, 74 denotes a data input by way of which the process control 72 can receive an information pattern which, by way of example, is indicated here by a barcode and a numerical sequence.

Functional patterns 36 can furthermore also be formed as technical patterns. Technical patterns are linked to technical functionality. This includes for example sensors for detecting environmental characteristics, e.g. light sensors, fuel sensors, distance sensors, touch sensors or the like, as well as solar cells and light diodes (LEDs) and organic light diodes (OLEDs). Electrical or electronic circuits and electrical conductors, to which other technical patterns or other electrical or electronic assemblies can be connected, can be imprinted as technical patterns.

Such technical patterns can also be applied to surfaces according to the principle of inkjet printers, which is known in particular for solar cells, distance sensors, electronic circuits, LEDs or OLEDs.

It is also possible to print functional patterns 36 which fulfil several functions at the same time. For example, a printed RFID transponder, from which information can be read out, is both an information pattern and a technical pattern.

The printing of RFIDs is known per se from the prior art.

Moreover, both information patterns and technical patterns can be printed as custom patterns and hidden in the décor, so to speak, in order to conceal the real functionality for the consumer or end user.

The functional patterns 36 can always be applied to an object retrospectively by means of separate print robots 32 or print heads 34 guided in some other way. It is also possible to retrospectively apply additional functional patterns 36 to already existing functional patterns 36. This can be necessary for example if, as a result of retrofitting equipment features of a vehicle, the equipment list changes and is then incorporated in an information pattern which is adapted thereto.

It is also possible to apply functional patterns 36 to an object during or after a repair or maintenance work. For example, information about the operating steps and maintenance or repair work carried out can thereby be applied to the object—also in coded form.

The individual process steps required to generate the functional pattern 36 can vary depending on where the functional pattern is applied and the manner in which this takes place.

If required, the print robot 32 can cooperate with a camera system, which thereby enables the functional pattern 36 to be applied to the object, therefore in the present exemplary embodiment to the vehicle body 14, with the smallest possible positional tolerances and also to be checked after its application.

In addition to the print head 34, a print robot 32 can also carry further treatment units with it, for example in order to prevent the functional pattern 36 or, in the case of a multi-layer functional pattern 36, a layer thereof from bleeding. Treatment units of this type can be for example thermal or radiation units by means of which a printed layer is dried or hardened by thermal radiation or electromagnetic radiation.

All patterns, be they custom, information or technical patterns, can be formed as relief patterns 56 as shown in FIGS. 4 and 5.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A method for surface-treating vehicle bodies or parts thereof comprising:

providing a vehicle body or parts thereof with a functional pattern by means of a coating procedure, wherein the functional pattern is provided in the course of a painting process in which the vehicle body or parts thereof is coated in one or more steps in a coating chamber and the vehicle body or a parts thereof is provided with the functional pattern by means of a pattern application device that is movably guided by a robot; and further wherein the functional pattern is imprinted on a printing surface of the vehicle body or parts thereof, which is a surface region of the vehicle body or parts thereof which, during the coating process for the coating or after its completion, is located externally and is available for printing.

2. The method according to claim 1, wherein the functional pattern is integrated in the coating of the vehicle body or parts thereof or is applied externally on the coating of the vehicle body or parts thereof.

3. The method according to claim 1, wherein the printing surface is formed on the surface of a material wall of the vehicle body or parts thereof or a layer of a coating material.

4. The method according to claim 1, wherein the functional pattern is a custom pattern, an information pattern or a technical pattern.

5. The method according to claim 1, wherein the functional pattern is formed as a relief pattern.

6. The method according to claim 1, wherein the application device controlled by the robot is a multi-axis print robot having a print head.

7. The method according to claim 1, wherein the robot further guides a paint application device in addition to the pattern application device, the robot carrying an exchangeable head having the paint application device and the pattern application device.

8. A method for surface-treating vehicle bodies or parts thereof comprising:

providing a vehicle body or parts thereof with a functional pattern by means of a coating procedure, wherein the functional pattern is provided in the course of a painting process in which the vehicle body or parts thereof is coated in one or more steps in a coating chamber and the vehicle body or a parts thereof is provided with the functional pattern by means of a pattern application device that is movably guided by a robot; and further wherein the functional pattern is formed as a relief pattern.

9. The method according to claim 8, wherein the functional pattern is integrated in the coating of the vehicle body or parts thereof or is applied externally on the coating of the vehicle body or parts thereof.

10. The method according to claim 8, wherein the functional pattern is imprinted on a printing surface of the vehicle body or parts thereof, which is a surface region of the vehicle body or parts thereof which, during the coating process for the coating or after its completion, is located externally and is available for printing, wherein the printing surface is formed on the surface of a material wall of the vehicle body or parts thereof or a layer of a coating material.

11. The method according to claim 8, wherein the functional pattern is a custom pattern, an information pattern or a technical pattern.

12. The method according to claim 8, wherein the application device controlled by the robot is a multi-axis print robot having a print head.

13. The method according to claim 8, wherein the robot further guides a paint application device in addition to the pattern application device, the robot carrying an exchangeable head having the paint application device and the pattern application device.

14. A method for surface-treating vehicle bodies or parts thereof comprising:

providing a vehicle body or parts thereof with a functional pattern by means of a coating procedure, wherein the functional pattern is provided in the course of a painting process in which the vehicle body or parts thereof is coated in one or more steps in a coating chamber and the vehicle body or a parts thereof is provided with the functional pattern by means of a pattern application device that is movably guided by a robot; and further wherein the application device controlled by the robot is a multi-axis print robot having a print head.

15. The method according to claim 14, wherein the functional pattern is integrated in the coating of the vehicle body or parts thereof or is applied externally on the coating of the vehicle body or parts thereof.

16. The method according to claim 14, wherein the functional pattern is imprinted on a printing surface of the vehicle body or parts thereof, which is a surface region of the vehicle body or parts thereof which, during the coating process for the coating or after its completion, is located externally and is available for printing, wherein the printing surface is formed on the surface of a material wall of the vehicle body or parts thereof or a layer of a coating material.

17. The method according to claim 14, wherein the functional pattern is a custom pattern, an information pattern or a technical pattern.

18. The method according to claim 14, wherein the robot further guides a paint application device in addition to the pattern application device, the robot carrying an exchangeable head having the paint application device and the pattern application device.

19. A method for surface-treating vehicle bodies or parts thereof comprising:

providing a vehicle body or parts thereof with a functional pattern by means of a coating procedure, wherein the functional pattern is provided in the course of a painting process in which the vehicle body or parts thereof is coated in one or more steps in a coating chamber and the vehicle body or a parts thereof is provided with the functional pattern by means of a pattern application device that is movably guided by a robot; and further wherein the robot further guides a paint application device in addition to the pattern application device, the robot carrying an exchangeable head having the paint application device and the pattern application device.

20. The method according to claim 19, wherein the functional pattern is integrated in the coating of the vehicle body or parts thereof or is applied externally on the coating of the vehicle body or parts thereof.

21. The method according to claim 19, wherein the functional pattern is imprinted on a printing surface of the vehicle body or parts thereof, which is a surface region of the vehicle body or parts thereof which, during the coating process for the coating or after its completion, is located externally and is available for printing, wherein the printing surface is formed on the surface of a material wall of the vehicle body or parts thereof or a layer of a coating material.

22. The method according to claim 19, wherein the functional pattern is a custom pattern, an information pattern or a technical pattern.

* * * * *